US012326081B2

(12) United States Patent
Peter et al.

(10) Patent No.: US 12,326,081 B2
(45) Date of Patent: Jun. 10, 2025

(54) TAGGING ASSEMBLY INCLUDING A SACRIFICIAL STOP COMPONENT

(71) Applicants: Andreas Peter, Celle (DE); Volker Peters, Wienhausen (DE); Thorsten Regener, Wienhausen (DE); Kjell Magne Gronaas, Sandnes (NO); Frank Johnsen, Hundvaag (NO); Gaute Grindhaug, Stavanger (NO); Freddy Seterdal, Stavanger (NO); Rick Frey, Hannover (DE); Kjetil Holden, Celle (DE)

(72) Inventors: Andreas Peter, Celle (DE); Volker Peters, Wienhausen (DE); Thorsten Regener, Wienhausen (DE); Kjell Magne Gronaas, Sandnes (NO); Frank Johnsen, Hundvaag (NO); Gaute Grindhaug, Stavanger (NO); Freddy Seterdal, Stavanger (NO); Rick Frey, Hannover (DE); Kjetil Holden, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 7 days.

(21) Appl. No.: 17/361,402

(22) Filed: Jun. 29, 2021

(65) Prior Publication Data

US 2021/0404324 A1 Dec. 30, 2021

Related U.S. Application Data

(60) Provisional application No. 63/045,425, filed on Jun. 29, 2020.

(51) Int. Cl.

| | |
|---|---|
| ***E21B 47/09*** | (2012.01) |
| ***E21B 34/06*** | (2006.01) |
| ***E21B 47/013*** | (2012.01) |

(52) U.S. Cl.
CPC ..... *E21B 47/09* (2013.01); *E21B 34/063* (2013.01); *E21B 47/013* (2020.05)

(58) Field of Classification Search
CPC ..... E21B 47/09; E21B 47/013; E21B 34/063
See application file for complete search history.

(56) References Cited

U.S. PATENT DOCUMENTS 3,333,635 A * 8/1967 Crawford ..... E21B 43/086 166/276
4,875,966 A 10/1989 Perko
(Continued)

FOREIGN PATENT DOCUMENTS

CN 109403911 A 3/2019

OTHER PUBLICATIONS

International Search Report for International Application No. PCT/US2021/039496; International Filing Date Jun. 29, 2021; Date of Mailing Oct. 5, 2021; 3 pages.
(Continued)

*Primary Examiner* — Theodore N Yao
(74) *Attorney, Agent, or Firm* — CANTOR COLBURN LLP

(57) ABSTRACT

An apparatus for determining a location of an inner string in an outer string includes an axis parallel to a longitudinal axis of the inner string, and a tagging assembly disposed at a tagging location in the outer string, the outer string configured to be deployed into a borehole in a subterranean region, the inner string configured to be advanced through the outer string. The tagging assembly includes a stop component configured to obstruct axial movement of the inner string
(Continued)

through the outer string at the tagging location, the stop component configured to be displaced in response to an axial force applied to the stop component by the inner string, to permit the inner string to advance axially beyond the tagging assembly.

23 Claims, 8 Drawing Sheets

(56) References Cited

U.S. PATENT DOCUMENTS

| | | | | |
|---|---|---|---|---|
| 5,035,292 | A * | 7/1991 | Bailey | E21B 29/06 175/48 |
| 5,762,149 | A | 6/1998 | Donovan et al. | |
| 6,138,761 | A | 10/2000 | Freeman et al. | |
| 6,648,075 | B2 | 11/2003 | Badrak et al. | |
| 6,712,150 | B1 | 3/2004 | Misselbrook et al. | |
| 6,719,070 | B1 | 4/2004 | Van Puymbroeck et al. | |
| 7,004,265 | B2 | 2/2006 | Van Puymbroeck et al. | |
| 7,306,044 | B2 | 12/2007 | Connell et al. | |
| 8,074,749 | B2 | 12/2011 | Twardowski et al. | |
| 8,267,172 | B2 | 9/2012 | Surjaatmadja et al. | |
| 8,479,818 | B2 | 7/2013 | Rayssiguier | |
| 9,217,308 | B2 | 12/2015 | Wood et al. | |
| 9,291,435 | B2 | 3/2016 | Scheid et al. | |
| 9,518,452 | B2 | 12/2016 | Turley et al. | |
| 9,605,533 | B2 | 3/2017 | Eriksen et al. | |
| 9,695,970 | B2 | 7/2017 | Rogers et al. | |
| 9,726,004 | B2 | 8/2017 | Echols, III et al. | |
| 9,745,451 | B2 | 8/2017 | Zhao et al. | |
| 9,951,612 | B2 | 4/2018 | Brown-Kerr et al. | |
| 10,094,190 | B2 | 10/2018 | Grattan et al. | |
| 10,119,011 | B2 | 11/2018 | Zhao et al. | |
| 10,202,820 | B2 | 2/2019 | Xu et al. | |
| 10,227,471 | B2 | 3/2019 | Wang et al. | |
| 10,329,407 | B2 | 6/2019 | Duan et al. | |
| 10,458,197 | B2 | 10/2019 | Khatiwada et al. | |
| 10,557,329 | B2 | 2/2020 | Gao et al. | |
| 2007/0163776 | A1* | 7/2007 | Sorensen | E21B 33/12 166/179 |
| 2013/0310961 | A1* | 11/2013 | Intriago Velez | B22F 5/106 700/97 |
| 2015/0275643 | A1* | 10/2015 | Holder | G01N 29/04 166/63 |
| 2016/0222778 | A1* | 8/2016 | Mata | E21B 47/00 |
| 2016/0369619 | A1* | 12/2016 | Parmeshwar | E21B 44/02 |
| 2017/0247960 | A1 | 8/2017 | Kyle et al. | |
| 2018/0313183 | A1* | 11/2018 | Hiorth | E21B 33/1208 |
| 2019/0017345 | A1* | 1/2019 | Brandsdal | E21B 34/063 |
| 2019/0093454 | A1* | 3/2019 | Styler | E21B 34/142 |
| 2019/0390543 | A1 | 12/2019 | Merino et al. | |
| 2022/0349276 | A1* | 11/2022 | Kumar | E21B 33/12 |

OTHER PUBLICATIONS

Written Opinion for International Application No. PCT/US2021/039496; International Filing Date Jun. 29, 2021; Date of Mailing Oct. 5, 2021; 5 pages.

* cited by examiner

TAGGING ASSEMBLY INCLUDING A SACRIFICIAL STOP COMPONENT

CROSS REFERENCE TO RELATED APPLICATIONS

This application claims the benefit of an earlier filing date from U.S. Provisional Application Ser. No. 63/045,425 filed Jun. 29, 2020, the entire disclosure of which is incorporated herein by reference.

BACKGROUND

In the resource recovery industry, various operations are performed to evaluate resource bearing formations and recover resources such as hydrocarbons. Such operations include drilling, directional drilling, completion and production operations. Drilling and completion processes typically entail deploying a drill string with a drill bit, drilling a section of a borehole, removing the drill string, and subsequently deploying a section of casing or liner and cementing the casing or liner in the borehole.

In addition to traditional drilling, techniques have been developed in which liner, casing or other tubulars are advanced with a drilling assembly during the drilling process. Such techniques include casing drilling and liner drilling. In casing drilling, a bottomhole assembly including a drill bit is attached to a section of casing and, after drilling, the casing is hung at the top of the wellbore. In liner drilling, the liner to be cemented serves as a part of a drill string, is advanced in a borehole and/or rotated within the borehole with the drill string, and remains in place after the drill string is withdrawn from the borehole. The liner may be rotated with the drill string, or a mud motor can be attached to the drill string and used to rotate a drill bit while the liner is not rotating.

SUMMARY

An embodiment of an apparatus for determining a location of an inner string in an outer string includes an axis parallel to a longitudinal axis of the inner string, and a tagging assembly disposed at a tagging location in the outer string, the outer string configured to be deployed into a borehole in a subterranean region, the inner string configured to be advanced through the outer string. The tagging assembly includes a stop component configured to obstruct axial movement of the inner string through the outer string at the tagging location, the stop component configured to be displaced in response to an axial force applied to the stop component by the inner string, to permit the inner string to advance axially beyond the tagging assembly.

An embodiment of a method of determining a location of an inner string of a downhole system includes deploying an outer string into a borehole in a subterranean region, the outer string including a tagging assembly, the tagging assembly including a stop component disposed at a tagging location in the outer string, and deploying the inner string and advancing the inner string until the inner string engages the stop component, the stop component obstructing axial movement of the inner string at the tagging location. The method also includes performing a measurement to determine a position of the inner string relative to the outer string, displacing the stop component by applying an axial force to the stop component by the inner string to permit the inner string to advance axially beyond the tagging assembly, and performing a downhole operation based on the measurement.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
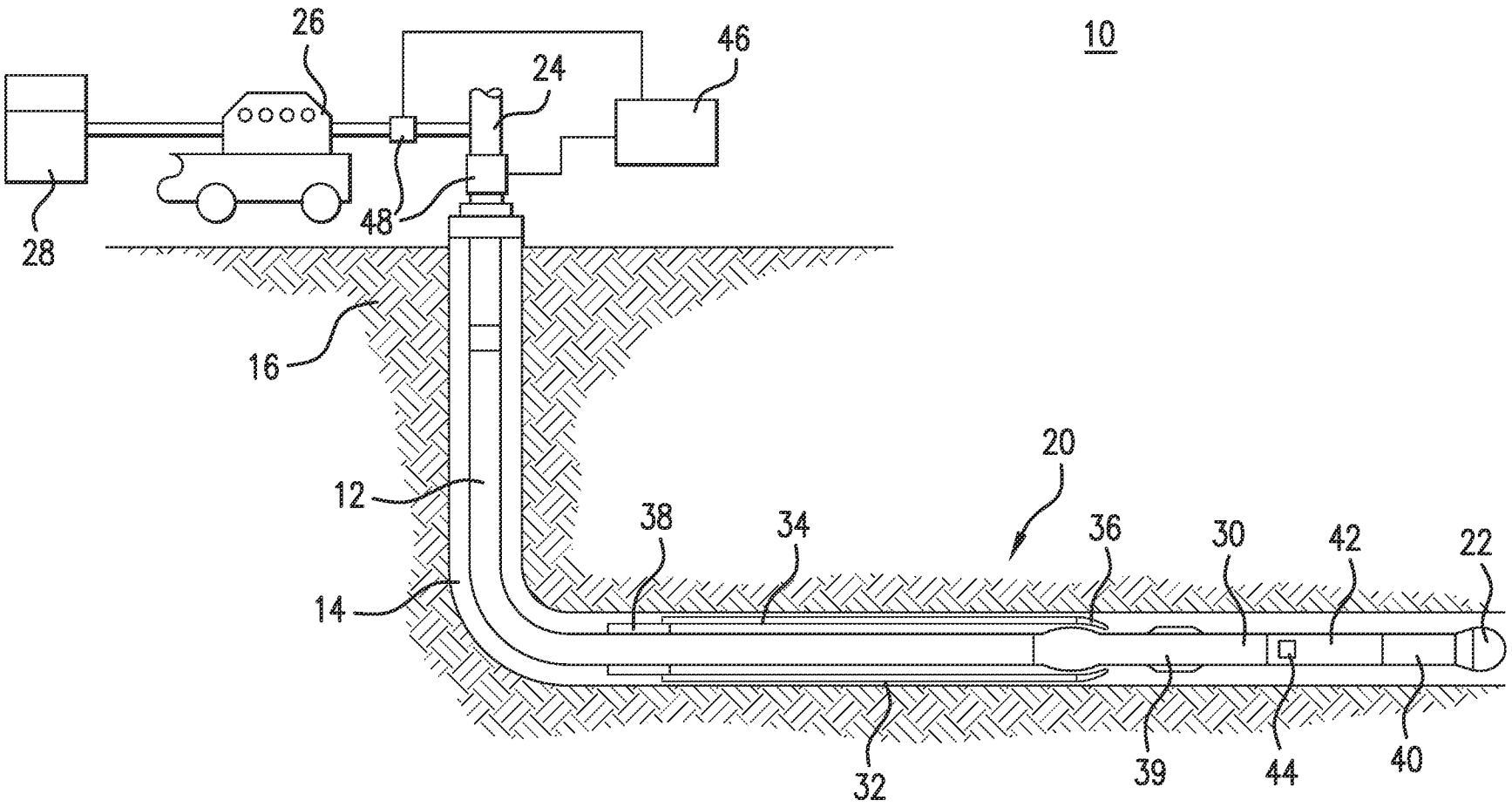
FIG. 1 depicts an embodiment of a drilling and completion system.

A detailed description of one or more embodiments of the disclosed apparatus and method are presented herein by way of exemplification and not limitation with reference to the Figures.

Systems, apparatuses and methods are provided for determining a relative location of an inner string in an outer string of a drilling system. An embodiment of a drilling and completion system includes a tagging assembly disposed at a fixed location in the outer string. The outer string may include a liner, casing or other tubular that is left in a borehole after drilling. The inner string includes a drilling assembly and a drill bit, which are configured to be advanced through the outer string. After the drilling assembly is advanced beyond the outer string, the drilling assembly is operated to drill a section of a borehole. The outer string is advanced with the drilling assembly during drilling, and can be cemented in place after the section is drilled.

An embodiment of the tagging assembly includes a sacrificial stop component at a fixed location in the outer string. The stop component extends radially inwardly into a conduit formed by the outer string, and is configured to obstruct axial movement of the inner string through the outer string and through the conduit when the drill bit contacts or otherwise engages the stop component. "Axial" movement, in one embodiment, refers to movement along a longitudinal axis of the inner string and/or outer string (e.g., an axis A shown in FIG. 2) in a downhole direction. The stop component allows for measurement of the position of the inner string relative to the outer string to ensure that the inner string is properly positioned in the outer string. After the measurement, weight-on-bit is increased to apply an axial force sufficient to cause the stop component to disintegrate. The inner string can then be advanced beyond the tagging assembly in a downhole direction to a drilling position, secured to the outer string, and the system can be operated to drill the borehole length. The measurement of the position of the inner string relative to the outer string can be considered to be a location calibration of the inner string in the outer string.

In one embodiment, the tagging assembly and/or the sacrificial stop component is disposed at or proximate to a lower-most or downhole end of the outer string (e.g., at the lower-most end or as close as is feasible to the lower-most end). For example, as discussed further below, the stop component can be located at a shoe of a liner or other tubular. Locating the stop component in such a manner can be beneficial, for example, to compensate for tolerances of length dimensions, different deformation of the inner and outer strings (e.g., different stretch of outer string and inner string due to gravity) and potential errors in recorded or measured length dimensions of the outer and inner strings. It is noted that a "lower" component or location is a component or location that is further from the surface as compared to a reference location, and corresponds to a lower true vertical depth (TVD) or lower measured depth (MD). A "downhole" location is a location further from the surface relative to a reference location. Movement in a downhole direction refers to axial movement along a borehole or along the outer string away from the surface. Accordingly, movement in an uphole direction refers to axial movement along the borehole or along the outer string toward the surface.

The stop component is configured to be displaced in response to an axial force to release the obstruction and permit the inner string to be moved past the location of the tagging assembly in the downhole direction. The inner string can then be advanced to a desired position in the borehole to ready the drilling and completion assembly for drilling. In one embodiment, the stop component is made from a material and/or is configured to break up into pieces that can be circulated out of the borehole or otherwise crushed small enough so that they do not interfere with functionality of drilling and completions processes. In another embodiment, the stop component can be made from an elastic, flexible and/or deformable material that can deform and be pushed through the outer string. It is noted that in some embodiments, the tagging assembly and/or stop component includes various combinations of the materials.

In one embodiment, the stop component is made from a material that has material properties selected so that an axial force applied by the inner string (with or without rotating the drill bit) shatters or disintegrates the stop component into small pieces that can be circulated out of the borehole, or that do not impose a risk for the subsequent drilling process. For example, the stop component is made from glass and/or other materials that have a brittleness selected so that axial force above a threshold causes the stop component to shatter, crush, or otherwise disintegrate into pieces that are sufficiently small to be circulated with borehole fluid. The pieces or fragments of the stop component can be of various sizes, and can be ground to even smaller pieces in the subsequent drilling process without imposing damage to the drill bit, until they are small enough to be circulated out with borehole fluid. In another embodiment, the stop component is perforated or otherwise formed so that the stop component breaks into pieces of a desired size or size range.

In one embodiment, the stop component can be made from a material that can be sheared during application of an axial force applied by the inner string (e.g., by the drill bit) and can subsequently be shredded, broken, crushed or ground at a later time to reduce the material to pieces of a size small enough to be circulated with borehole fluid to the surface where the material is filtered out of the borehole fluid. For example, the material and/or size of the pieces are selected so that the materials can be ground when drill bit rotation is established in a later state.

Embodiments described herein present a number of advantages. For example, the stop component provides a simple and effective way to tag the inner string and measure the position of the inner string relative to the outer string, without the need to install potentially more complex components, such as sensors or other tagging mechanisms. For example, conventional liner drilling systems utilize sensors that require transmission and analysis of data, or landing splines that could potentially break and get stuck in a borehole. The embodiments described provide for an effective tagging method that does not require sensors or components (e.g., spline, radial bolts, etc.) that could potential be left in the hole and interfere with drilling operations.

FIG. 1 illustrates an example of a system 10 that can be used to perform one or more subterranean operations, such as a drilling and completion operation. The system 10 includes downhole components 12 disposed in a borehole 14 that penetrates at least one earth formation 16. Although the borehole 14 is shown in FIG. 1 to be of constant diameter, those of skill in the art will appreciate boreholes are not so limited. For example, the borehole 14 may be of varying diameter and/or direction (e.g., azimuth and inclination). The downhole components 12 include various components or assemblies, such as a drilling assembly and various measurement tools and communication assemblies, one or more of which may be configured as a bottomhole assembly (BHA).

The system 10, in one embodiment, includes a drilling and completion assembly 20 having a drill bit 22 or other disintegrating device. The drill bit 22 may be driven by rotating the inner string 30 and/or using a downhole motor (e.g., a mud motor). The system 10 has surface equipment 24 that includes various components for performing functions such as deploying downhole components, adding drill pipe or other string components, rotating the borehole string, acquiring measurements and/or others. The surface equipment may include a derrick, a top drive, a hook, a rotary table, and a drawworks.

The system 10 also includes components to facilitate circulating fluid such as drilling mud and/or a cement slurry through an inner bore of the inner string 30 and the annulus between the inner string 30 and the borehole 14 or an outer string 32. A pumping device 26 is located at the surface to circulate fluid from a mud pit or other fluid source 28 through a stand pipe into the inner bore of the inner string 30 and into the borehole 14.

In one embodiment, the system 10 includes capabilities to perform drilling operations in which components of a completion or other tubulars are deployed and advanced during drilling. Liner while drilling, or liner drilling, involves deploying a liner in a borehole, as part of or connected to a drill string, and advancing the liner with a drilling assembly as a section of a borehole is drilled. Casing drilling, or casing while drilling (CwD) involves running casing into a borehole with a drill bit and drilling the borehole using a casing string to rotate the drill bit. Embodiments are described herein in conjunction with liner drilling, although it is to be understood that the embodiments can apply to various types of drilling operations in which a liner, casing and/or other completion components are deployed with a drilling assembly or an inner string is to be placed relative to an outer string.

In this embodiment, the drilling and completion assembly 20 is a liner drilling assembly that includes an inner string 30 and an outer string 32. The outer string includes a tubular, such as a liner 34, that is deployed and left downhole to seal off a section of formation from the borehole 14. The outer string 32 may include conventional casing and liners or any other tubular that may be left downhole and/or cemented in place. The outer string 32 may include other components, such as a liner shoe 36 and a setting sleeve 38. The liner shoe 36 may include a reamer bit.

The drilling and completion assembly 20 may include additional components for facilitating drilling and/or completion. For example, a hole opening device, such as an expandable under-reamer 39, may be included to increase the size of the borehole from the size of the drill bit 22 to a size that can accommodate the outer string 32. The inner string 30 may include a steering device 40, such as a rotary steering assembly or mud motor with a bent sub assembly. In addition, the drilling and completion assembly 20 may include one or more of various sensing devices. Examples of sensing devices include temperature sensors, pressure sensors, fluid sensors, accelerometers, magnetometers, gamma resistivity tools, pulsed neutron tools, magnetic resonance sensors, acoustic tools and others. For example, the inner string includes a logging while drilling (LWD) and/or measurement while drilling (MWD) device 42. The device 42 may be assembled with the steering device 40 and the drill bit as, e.g., a BHA.

Sensors or measurement devices may also be included in the surface equipment 24. For example, the surface equipment 24 includes fluid pressure and/or flow rate sensors 48 for measuring fluid flow into and out of the borehole 14. A fluid pressure sensor may detect pressure variations in the fluid column in the borehole 14 used to transmit data in a mud pulse telemetry system.

In one embodiment, one or more downhole components and/or one or more surface components may be in communication with and/or controlled by a processor such as a downhole processor 44 and/or a surface processing unit 46. In one embodiment, the surface processing unit 46 is configured as a surface control unit which controls various parameters such as rotary speed, weight-on-bit, fluid flow parameters (e.g., pressure and flow rate) and others. The surface processing unit 46 may include a surface computer, a monitor, and a memory. The surface processing unit 46 is configured to receive, transmit, process and store data transmitted from downhole to uphole (uplink) and/or from uphole to downhole (downlink) through a communication channel, such as wired pipe, mud pulse telemetry, acoustic telemetry or electromagnetic telemetry.

One or more processing devices, such as the processing unit 46 (and/or the downhole processor 44), may be configured to perform functions such as controlling deployment of the inner string 30 and/or the outer string 32, controlling drilling and steering, controlling the pumping of borehole fluid and/or cement injection, making downhole measurements, transmitting and receiving data, processing measurement data, expanding and retraction an expandable under-reamer and/or monitoring operations of the system 10. Various functions discussed herein may be performed by a human operator, a processing device, or by a processing device in combination with an operator.

Prior to a liner drilling operation, the system is assembled by installing the inner string 30 inside the outer string 32. First, the outer string 32 is run into the borehole 14, and the upper end of the outer string 32 remains attached to the surface (e.g., at a rig floor). The inner string 30 is then deployed and run into the borehole 14, into the outer string 32 until attachment elements (such as landing splines) in the inner string 30 engage landing structures (e.g., grooves, splines, etc.). Alternatively, or in addition, markers such as magnets or radioactive markers in the outer string 32 and respective sensors in the inner string 30 can be deployed for position detection. At this point, the relative positions of the inner string 30 and the outer string 32 to each other are determined. Once the relative position of the inner string 30 relative to the outer string 32 is determined, the position of the inner string 30 is adjusted as needed to ensure that the inner and outer strings are properly engaged, and the assembly process can be completed by engaging the inner string 30 with the outer string 32 using a running tool including expandable anchors to anchor the inner sting 30 in anchor cavities in the outer string 32. The drilling and completion assembly 20 can then be further advanced to the bottom of the borehole 14 and drilling may commence. The adjusting of the position of the inner string 30 is performed by moving the inner string 30 axially through the outer string 32 in the uphole or downhole direction (e.g., picking-up, running in hole).

Properly positioning the inner string 30 is important for effectively performing various operations. By knowing the relative position of the inner string 30 in the outer string 32, structures can be correctly engaged and operated downhole as intended by moving the inner string 30 a defined distance from the tagging assembly in the uphole or downhole direction to align structures in the outer string with corresponding structures in the inner string. Examples of structures or components that may rely on proper positioning include anchor modules, latching elements, packers, measurement tools, testing tools, expandable reamers, extendable stabilizers, anchors, hanger activation tools, liner drive subs, workover tools, milling tools, cutting tools and/or communication devices. The relative position of the inner string 30 to the outer string 32 is determined by detecting the tagging assembly in the outer string 32. By knowing the position of the tagging assembly in the outer string 32, the position of all other structures inside the outer string 32 are known because the distance of these structures inside the outer string 32 to the position of the tagging assembly is known. The distance between the lower-most end of the inner string 30 and the corresponding structures in the inner string 30 is known as well. Therefore, tagging the tagging assembly in the outer string 32 with the inner string 30 calibrates the relative position of the inner and outer string to each other and allows for aligning a corresponding specific structure in the inner string 30 with a specific structure in the outer string 32.

Aligning a specific structure in the outer string 32 with a corresponding specific structure in the inner string 30 may include placing the inner string 30 in the outer string 32 so that fast spinning components of the BHA (e.g. components below a mud motor) are outside of the liner 34 and below the reamer bit in the liner shoe 36, so as to not damage the reamer bit or the inner string 30 by interaction of the reamer bit and the inner string 30. Adjusting the relative position of the inner and outer string to each other may be achieved by either extending the inner string 30 by adding inner string components, or by shortening the inner string 30 by removing inner string components (e.g., drill joints). For example, a drill joint is around 30 feet (~9 m) long, thus adding or removing a drill joint lengthens or shortens the inner string 30 by about 30 feet. If adjusting the relative position of the inner and outer string to each other entails a different length adjustment than a length of a standard drill joint, joints with a different lengths (e.g. a pup joint) may be deployed, such as joints with lengths of about 0.5 m to about 1 m, about 0.5 m to about 3 m, about 0.5 m to about 5 m, or about 0.5 to about 9 m.

Figure 2:
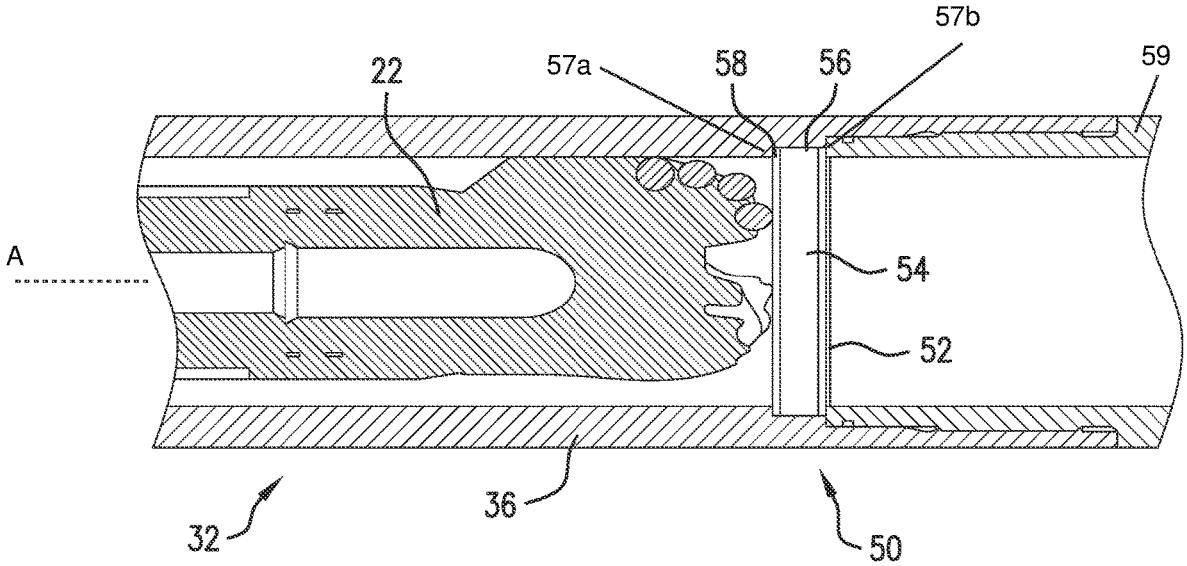
FIG. 2 depicts an embodiment of a tagging assembly disposed in an outer string of a liner drilling system, the tagging assembly including a sacrificial stop component.

Referring to FIG. 2, in one embodiment, the outer string 32 includes or is connected to a position determination assembly 50, which includes a sacrificial stop component 52 disposed relative to the outer string 32, and at a known location in the outer string 32 (referred to as a "tagging location"). The position determination assembly 50 allows for determining the relative position of the inner and outer string to each other. This determination is typically referred to as "tagging." As such, the position determination assembly 50 is also referred to as a tagging assembly 50. In one embodiment, the tagging assembly 50 and/or the stop component 52 may be fixedly disposed in the outer string 32. In another embodiment, the stop component 52 and/or the tagging assembly 50 may be loosely disposed in the outer string 32, such that the stop component 52 and/or the tagging assembly 50 can move relative to the outer string 32. The stop component 52 and/or the tagging assembly 50 may be disposed in a recess that allows small relative movement between the outer string 32 and the stop component 52 with respect to axial, lateral, and/or rotational movement.

The stop component 52 extends radially inward from the outer string 32 so that the drill bit 22 contacts the stop component 52 when sufficiently deployed. The relative positions of the outer and inner strings can be determined when it is detected that the drill bit 22 has come into contact with the stop component 52, or has otherwise been stopped or obstructed by the stop component 52. The stop component 52 and/or other components of the position determination or tagging assembly 50 may be located at any suitable location along the outer string 32, such as in or close to the liner shoe 36, or close to the downhole or lower end of the liner 34.

In an embodiment, the location of the stop component 52 in the outer string 32 may be defined as a reference location (also referred to as a tagging location). When the inner string 30 hits the stop component 52, the inner string 30 is considered to be at a reference position (also referred to as a tagging position). For example, the reference position or tagging position is defined as a zero meter (m) relative position between inner and outer string (tagging position). When the inner string 30 hits the stop component 52 with its lower most end, then the inner string 30 is considered to be at the tagging position in the outer string 32 (i.e., the positions of the inner string 30 and the outer string 32 are considered to be about the same for purposes of aligning structures). Knowing the distances of all outer string structures in the outer string 32 from the tagging position (zero m position), and knowing the distances of all inner string structures in the inner string 30 from the lower most end of the inner string 30 allows for aligning a specific structure in the outer string 32 with a corresponding specific structure in the inner string 30 by moving the inner string 30 by a distance that aligns the specific structure in the outer string 32 with the corresponding specific structure in the inner string 30. Therefore, hitting the stop component 52 in the outer string 32 with the inner string 30 calibrates the relative position between outer and inner string to each other. Being able to align a specific outer string structure with a specific inner string structure enables a downhole operation related to the specific inner and outer string structures, such as engaging an anchor in the inner string 30 with a recess in the outer string 32 (e.g., an anchor cavity). The distance the inner string 30 is to be moved to align a corresponding specific inner string structure with a specific outer string structure may be in the uphole direction (towards the surface) or in the downhole direction (further into the borehole).

The distance moved in the uphole direction may be defined as a negative distance (e.g. −3 m) and the distance moved in downhole direction may be a defined as a positive distance (e.g. +3 m). For example, a specific structure (e.g. anchor cavity) in the outer string is located −5 m from the tagging assembly in the outer string 32 (uphole direction). A corresponding specific structure in the inner string 30 (e.g. anchor) is located −2 m from the lower most end of the inner string. When the inner string 30 hits the stop component 52 in the tagging assembly (tagging position), the inner string 30 is to be moved by −3 m from the tagging position (in the uphole direction) to align the specific structure in the outer string (e.g., anchor cavity) with the specific corresponding structure in the inner string 30 (e.g., anchor). When the specific structure in the outer string 32 and the specific corresponding structure in the inner string 30 are aligned, the operation to engage the both structures can be performed. The engaging operation may be extending an anchor in the inner string 30 into an anchor cavity in the outer string 32 in order to connect the outer string 32 to the inner string 30 with respect to weight and/or torque transfer (running tool). With the inner and outer strings connected and aligned, the downhole operation can start, such as drilling the borehole with the combined inner string 30 (drill string) and outer string 32 (liner) with a reamer bit at its lower end. In embodiments, the lower most end of the inner string 30 may be located in the drill bit 22 connected to the inner string 30. In alternative embodiments the lower most end of the inner string 30 may be a tubular (e.g. a string pipe), a fishing tool, a milling tool, a workover tool, a bullnose, a wireline tool, or similar.

Multiple tagging assemblies 50 may be disposed inside the outer string 32 to provide redundancy, for example, if a tagging assembly 50 is prematurely crushed. For example, upper and lower tagging assemblies may be arrayed axially along the outer string 32 (e.g., in the shoe 36). If an upper stop component of the upper tagging assembly is unintentionally crushed (e.g., due to inadequate tripping speed), a lower stop component can be used for tagging and length adjustment.

The various tagging assemblies 50 may also differ in shape, material and subcomponents and may require forces of different magnitude to be disintegrated. Multiple tagging assemblies 50 may also be used to detect more than one position of interest, such as a drilling position, a cementing position, a reaming position and others. In embodiments, a first tagging assembly 50 may be used to indicate the approach of a second tagging assembly 50. The first tagging assembly 50 may be an advance-notice tagging assembly. The second tagging assembly 50 may be a calibration tagging assembly, used to calibrate the relative position of the inner and outer string to each other. When hitting and crushing the first tagging assembly 50, a variation in a weight-on-bit (WOB) measurement at surface can be observed. When observing the WOB variation (reduction)

due to the crushing of the first tagging assembly 50, the tripping speed may be reduced to approach the second tagging assembly 50 slowly to securely detect the second tagging assembly's location without unintentionally crushing it. When hitting the second tagging assembly 50, another variation of the WOB measurement can be detected at surface. At this point, the relative positions of the inner and outer string is known (calibration of relative position), and alignment of the inner string 30 and the outer string 32 can start. It is to be mentioned that with the WOB variation resulting from hitting the first tagging assembly 50, the calibration of the relative position of inner and outer string can be performed prior to hitting the second tagging assembly 50.

The reduced tripping speed when approaching the second tagging assembly 50 may be about 1 meter/minute (m/min) to about 2 m/min. In another embodiment, the tripping speed while approaching the second tagging assembly 50 may be about 1 m/min to about 5 m/min. In yet another embodiment, the tripping speed while approaching the second tagging assembly 50 may be about 1 m/min to about 10 m/min. Weight-on-bit may be measured by a weight-on-bit measurement device. The weight-on-bit-measurement device monitors a hook load sensor or measures the weight-on-bit downhole by means of a strain gauge. Weight-on-bit measurement values acquired downhole are transmitted to the surface. A surface processing unit 46 (FIG. 2) may include a processor configured to monitor measured weight-on-bit data and detect weight-on-bit-variations that indicate the tagging of the tagging assembly. Weight-on-bit-variations may be negative or positive peaks in the weight-on-bit data.

The stop component 52 is sacrificial, in that the stop component 52 can be broken, shattered or otherwise disintegrated due to force exerted on the stop component 52. In one embodiment, the stop component 52 is made from a material that is brittle enough, so that a sufficient axial force on the stop component 52 breaks the stop component 52 into pieces that are small enough to be circulated by borehole fluid and do not significantly restrict fluid flow or interfere with other components in the borehole. Examples of such material include cement, ceramics, plastics, rock, porcelain, building stone, and glass. It is noted that, due to the brittleness of the material, the stop component can be disintegrated without the need to drill through the stop component 52 or rotate the drill bit 22.

In an alternate embodiment, the stop component 52 is made of an elastic material to dampen an initial impact when hit by the drill bit 22. The elastic material may be breakable into pieces or configured as individual elements. The elements or pieces may be small enough to be circulated out of the borehole by borehole fluid, and/or may be ground to smaller pieces by the drill bit 22 once the system 10 is assembled, run to bottom and the drilling process has started. Examples of such stop components include a rope or a web made of Nylon, Kevlar or other suitable material.

In another embodiment, the stop component 52 is made from a ductile material, which can be sheared during application of an axial force by the drill bit 22. In a later state, when rotation of the drill string is established, the stop component 52 can further be shredded, broken, crushed or ground into pieces that are sufficiently small to be circulated with the borehole fluid to the surface when circulation is re-established. Examples of such material include aluminum, plastic, brass and others.

In a further embodiment, the stop component 52 is made of a robust material such as steel, but perforated or otherwise configured to break up into pieces or deform to permit the inner string 30 to advance. For example, the stop component 52 can be made from perforated sheet metal that can be bent radially outwards or otherwise deformed once the axial force applied by the drill bit exceeds a certain threshold force.

In one embodiment, the stop component 52 includes an opening or is otherwise configured to permit borehole fluid to be circulated through the outer string 32, for example, as the inner string 30 is advanced to the tagging assembly 50. For example, the stop component 52 can be a disc, cylinder or other annularly shaped component having a central opening that permits fluid flow through the stop component 52 prior to engagement with the drill bit 22.

The stop component 52 may include a plurality of discs, such as two discs. Using more than one disc allows for adjustment of the axial force required to disintegrate and/or displace the stop component 52 (threshold force). The disc may be, for example, about 40 mm to about 45 mm thick and may have a diameter of around 166 mm for a 7 inch liner. In case the stop component 52 includes two discs, each of the two discs may be about 20 mm to about 22.5 mm thick. In general, the diameter of the disc(s) is limited by the diameter of the liner 34, or the diameter of a recess in the outer string 32. The thickness of a disc is determined by the material of the disc, the drill bit type, and the desired axial force that disintegrates the disc (axial threshold force). The disc should survive a tripping operation. Therefore, the axial force required to disintegrate the disc should be selected to be not too small to avoid unintentionally disintegrating the disc during the tripping operation. Experiments proved that a disc suited to disintegrate at an axial threshold force corresponding to around ten tons of WOB, provides best operational properties.

The central opening (e.g., the central opening 55 discussed below) of the disc may have a diameter of around 50% of the outer diameter of the disc. For example, for a disc that is about 166 mm in diameter, the central opening may be around 83 mm. In an alternative embodiment, the diameter of the central opening may be less than 50% of the outer diameter of the disc, for example about 40% to about 49%, or about 30% to about 49%. In another embodiment, the diameter of the central opening may be more than 50% of the outer diameter of the disc, for example, about 51% to about 60%, or about 51% to about 70%.

The disc may include more than one opening. In embodiments, the disc may include one or more openings that are located off-center in the disc. The disc may be oriented in the outer string 32 substantially perpendicular to the longitudinal axis A. In alternative embodiments, the orientation of the disc may have an angle different than 90° to the longitudinal axis A, for example about 95 to about 100 degrees (or about 80 to about 85 degrees), or about 95 to about 110 degrees (or about 70 to about 85 degrees). The disc may have a clearance of around 1 mm at each side to the wall of the recess (the diameter of the disc may be about 2 mm smaller than the inner diameter of the recess).

For example, the stop component 52 may include one or more individual components having the shape of a bar, rod or pole (among others), each of which is positioned perpendicular or at least at an angle to the longitudinal axis of the outer string 32. The individual component(s) might individually already be small enough to be circulated to the surface once sheared or broken off from the tagging position. The number of individual component(s) included in the stop component 52 may be selected to adjust the amount of axial force (tagging force) needed to displace the stop component 52.

In an alternate embodiment, the stop component 52 is a solid disc without an opening and sealed inside the liner shoe 36 or otherwise configured to prevent formation fluid or gas from entering the outer string 32 from below the tagging assembly 50 in the event of a well control situation (e.g. a kick) during the assembly process of the liner drilling system 10. This will reduce or eliminate the need for other well control equipment to seal the liner inner diameter on surface.

Figure 3:
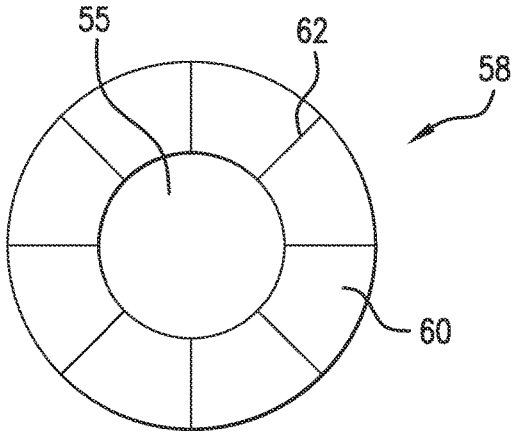
FIG. 3 depicts an embodiment of a force distribution component of the tagging assembly of FIG. 2.

FIGS. 2 and 3 depict an example of the tagging assembly 50, in which the stop component is an annular component such as a glass disc 54. The disc 54 has a central opening 55 (shown in FIG. 3) to allow borehole fluid to enter the outer string 32 as the outer string 32 is run into a borehole, facilitating the tripping-in process.

The disc 54 (or other stop component) may be disposed at the outer string 32 at a tagging location via any suitable securing mechanism, also referred to as a support structure. For example, the disc 54 is inserted into a groove, shoulder or other feature of the outer string 32. For example, the glass disc 54 is secured within a recess 56 formed in a connection (e.g., a pin-box connection, threaded connection, or threaded connection with an outer shoulder 57*a* to support the stop component) between the liner shoe 36 and a reamer bit sub 59 with a reamer bit (not shown) at the bottom end of the reamer bit sub 59. The outer shoulder 57*a* may be located in the liner shoe 36. A lower shoulder 57*b*, opposite the outer shoulder 57*a*, may be located on the upper end of the reamer bit sub 59. The upper end of the reamer bit sub 59 may include a pin connection while the lower end of the liner shoe 36 may include a box connection. In an alternative embodiment, the upper end of the reamer bit sub 59 may include a box connection and the lower end of the liner shoe 36 may include a pin connection. In alternate configurations, the stop component 52 may be installed inside the outer string 32 by a press fit, by glue, radial bolts or screws or other suitable fastening measures or components. In another embodiment, a component other than a reamer bit sub may be used to support the stop component 52 in the liner 34 (e.g., a dedicated securing sleeve). The stop component 52 may be loosely disposed (including axial clearance) in the recess 56, or may be fixed between shoulders 57*a* and 57*b* without axial clearance. In yet another embodiment, the securing of the stop component 52 may include lateral clearance in a direction perpendicular to the longitudinal axis A of the liner 34. The support structure as shown in FIG. 2 includes the recess 56 and the outer shoulder 57*a* and lower shoulder 57*b*.

The stop component (or components) 52 may have various shapes, such as bar, rod or pole, positioned perpendicular or at least at an angle to the longitudinal axis of the outer string 32. Such stop components 52 can be attached to the outer string 32 by means of threads, bolts, welding, gluing or other suitable fastening means. The fastening of bar, rod or pole stop components 52 can be applied through the wall of the outer string 32 and perpendicular or at least at an angle to the longitudinal axis A of the outer string 32.

In one embodiment, the tagging assembly 50 includes a force distribution component 58, such as a plastic disc, that is disposed on a surface of the glass disc 54 (or other stop component). The force distribution component 58 may be made from any suitable material, such as a polymer material (e.g. Polyether Ether Ketone (PEEK)), rubber, wood, cork, plastic, composite materials, or other material having a brittleness that is less than that of the disc 54. The force distribution component 58 may be disposed at an uphole side of the disc 54 or in general at a side of the disc facing the approaching inner string 30.

The force distribution component 58, in one embodiment, is configured so that, when the disc 54 is disintegrated, the component 58 breaks into a plurality of segments 60. The size(s) of the segments 60 is/are selected to be small enough so that the segments 60 can be circulated with borehole fluid. The segments 60 may be defined by grooves or cuts 62 or other weakening features, also referred to as predetermined breaking points.

The tagging assembly 50 may include a component or material configured to reduce the impact load on the disc 54 and/or the component 58, e.g., to avoid prematurely breakage when hitting the tagging assembly 50. In one embodiment, the tagging assembly 50 includes one or materials that can absorb and dampen the impact, such as rubber, polymer materials, or any other flexible material, referred to as an impact dampening component. The impact dampening component can be disposed on any surface of the disc 54 as desired, and can be configured as layers or discrete elements. The impact dampening component may include a single element or multiple elements.

Figure 4:
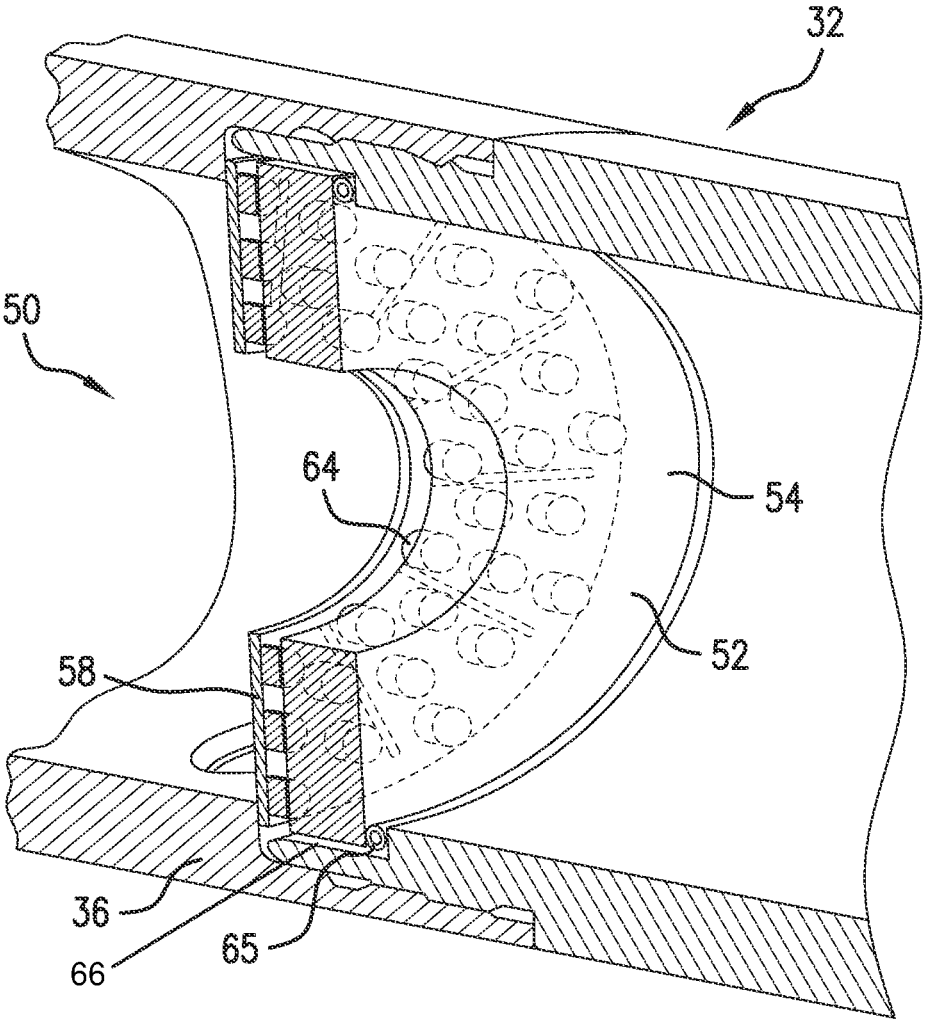
FIG. 4 depicts an embodiment of the tagging assembly of FIGS. 2 and 3, including elements of a different material than the sacrificial stop component and the force distribution component.

For example, as shown in FIG. 4, the impact dampening component includes impact dampening elements 64 that are disposed between the force distribution component 58 and the disc 54. In embodiments, the impact dampening elements 64 may be located between the stop component 52 and the force distribution component 58. The impact dampening elements 64 may be at the uphole side of the stop component 52 (upper impact dampening element). The impact damping elements 64 may form a layer, a web, or a grid. In an alternative embodiment, the impact damping elements 64 may take the form of multiple separate elements, such as knobs, pins, columns, balls, or the like. Although multiple individual elements 64 are shown, the impact dampening component is not so limited, and can be a single element or multiple elements located at various positions.

In another embodiment, an impact dampening component may be located at the downhole side of the stop component 52 (e.g., as a lower impact dampening element 65). The lower impact dampening element 65 may compensate for manufacturing tolerances and may dampen impacts on the disc 54. The lower impact dampening element 65 at the downhole side of the stop component 52 may take the form of a shim, a washer, a grommet, an o-ring, a gasket or a flexible tube. The lower impact damping element 65 may cover a full circle (360°) or only portions of a full circle (arc). If the lower impact dampening element 65 is a flexible tube (e.g. a rubber tube) or an o-ring, the tube or o-ring cross sections may be about 5 mm to about 10 mm. In another embodiment, the o-ring or tube cross sections may be about 6 mm to about 8 mm.

The impact damping component may include a lateral impact damping element 66 that may be disposed at the outer circumference of the disc 54 and in the portion of the recess 56 that is oriented substantially parallel to the longitudinal axis A. The lateral impact dampening element 66 dampens lateral impacts to avoid pre-mature displacement or disintegration of the stop component 52. In embodiments, the lower impact dampening element 65 may include a downhole sealing element, such as an o-ring to seal the disc 54 against the lower shoulder 57*b* (FIG. 2) of the recess 56. In another embodiment, the downhole sealing element may be an element separate to the lower impact dampening element 65. The downhole sealing element may be made from rubber, polymer materials, or any other flexible material. In embodiments, it may be beneficial to include an uphole sealing element on the uphole side of the tagging assembly 50 (not shown) such as an o-ring to seal the disc 54 against the outer shoulder 57*a* (FIG. 2) of the recess 56. The uphole sealing element may take the form of an o-ring or a flexible tube and may be made from rubber, polymer materials, or any other flexible material. The sealing elements may be utilized in a tagging assembly 50 including a solid disc with no central bore to seal the conduit in the liner 34 from borehole fluid.

Figure 5:
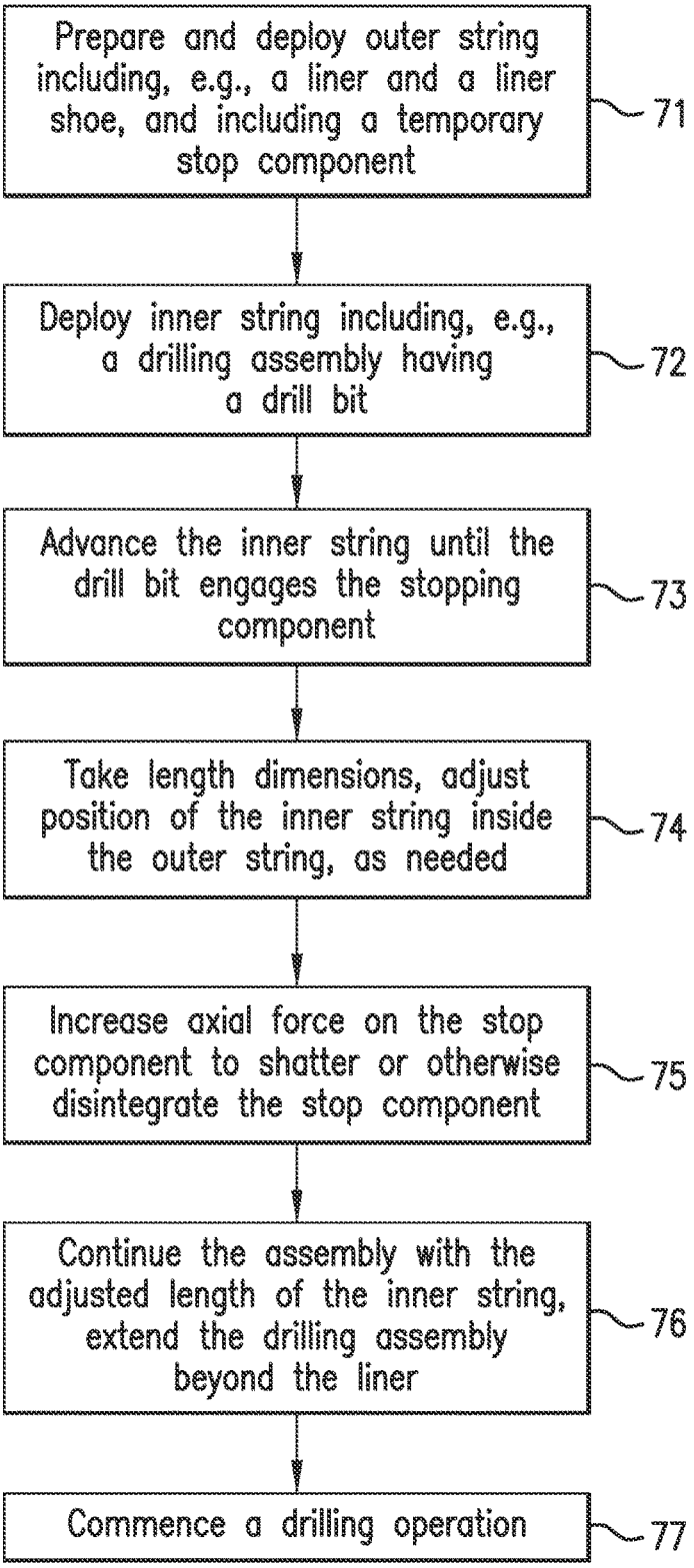
FIG. 5 is a flow chart depicting a method of assembling a drilling and completing system and drilling a section or length of a borehole.

FIG. 5 illustrates a method 70 of drilling and completing a length of a borehole. In one embodiment, the method 70 involves liner drilling, but is not so limited, as the method may be used in any context where it is desired to temporarily stop a downhole string or component.

The method 70 is described with reference to the system 10, although the method 70 may be utilized in conjunction with any suitable type of device or system for which tagging is desired, or for which a tagging assembly or stop component may be useful. The method 70 includes one or more stages represented by blocks 71-77. In one embodiment, the method 70 includes the execution of all of the blocks 71-77 in the order described. However, certain stages may be omitted, additional stages may be added, and/or the order of the stages may be changed.

The method 70 is discussed for illustrative purposes in conjunction with an example of components of a liner drilling system, shown in FIGS. 6-9. FIGS. 6-9 depict an example of the inner string 30 and the outer string 32, and show various phases of the method 70.

Figure 6:
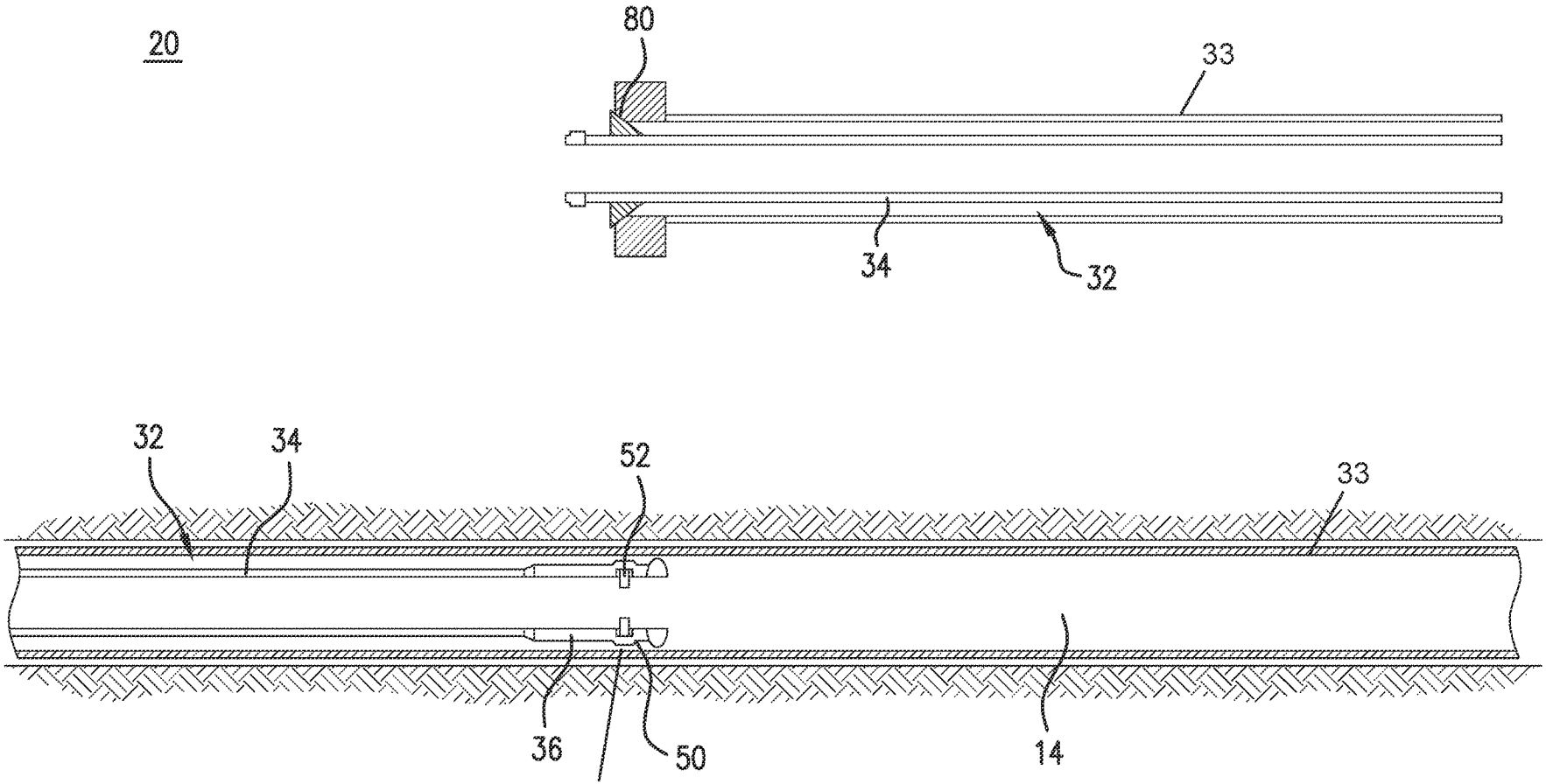
FIG. 6 depicts an embodiment of an outer string of a drilling and completion assembly as deployed in a borehole, the drilling and completion assembly including a tagging assembly having a sacrificial stop component.
Figure 7:
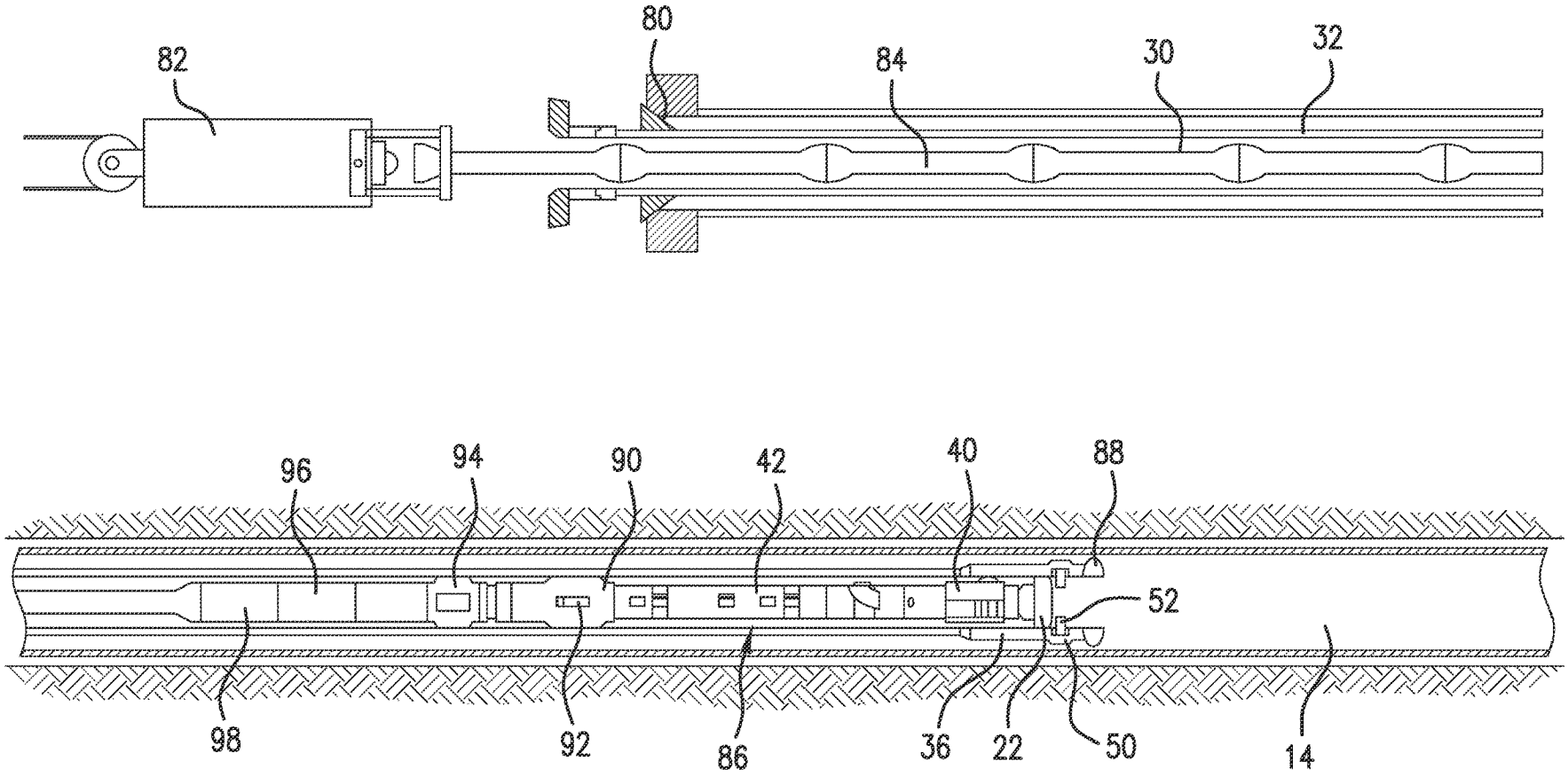
FIG. 7 depicts the drilling and completion assembly of FIG. 6, during an assembly phase in which a drill bit of an inner string is in engagement with the stop component.
Figure 8:
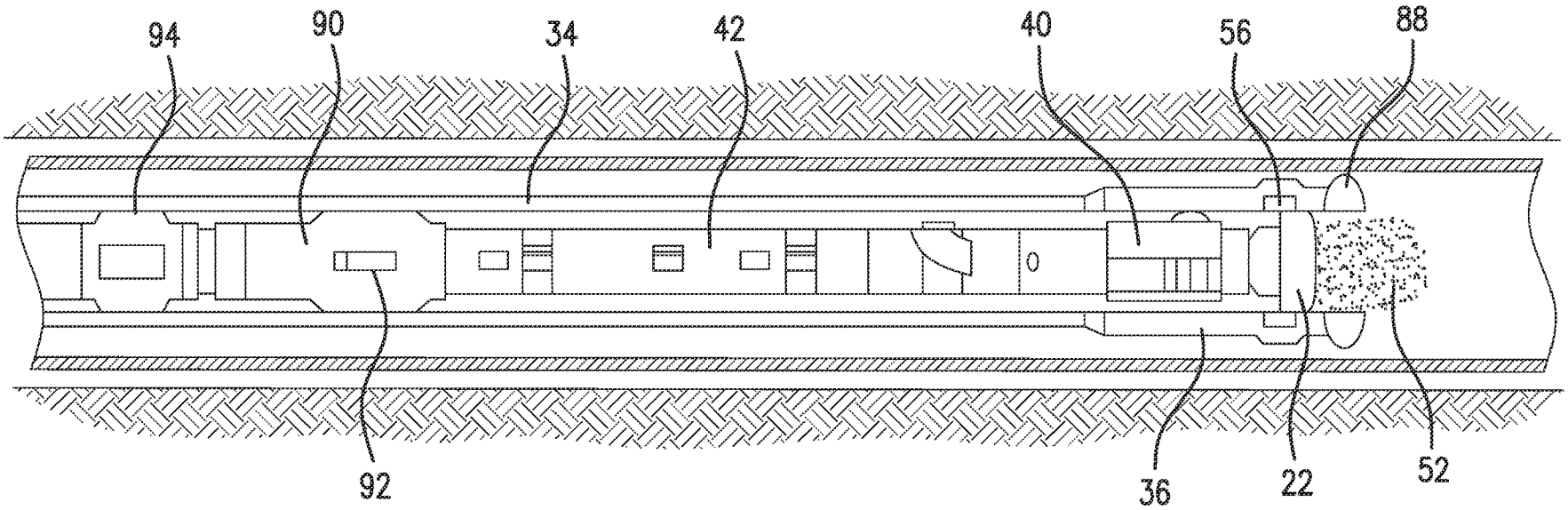
FIG. 8 depicts the drilling and completion assembly of FIGS. 6 and 7, during an assembly phase in which a sufficient force is applied to the stop component by the drill bit to crush, shatter or otherwise disintegrate the stop component.
Figure 9:
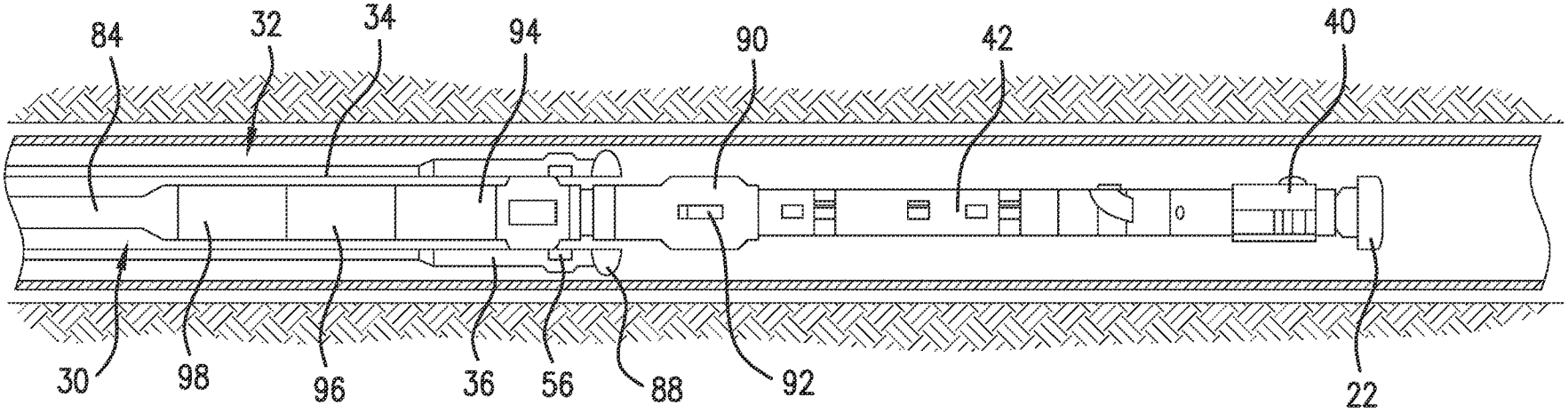
FIG. 9 depicts the drilling and completion assembly of FIGS. 6-8, during an assembly phase in which a drilling assembly including the drill bit is advanced axially beyond the tagging assembly in order to drill a borehole length.

FIG. 6 depicts an initial phase in which the outer string 32 has been deployed into the borehole 14, prior to deployment of the inner string 30. FIG. 7 depicts a phase in which the inner string 30 is deployed and advanced until the inner string 30 contacts or otherwise engages the tagging assembly 50. FIG. 8 depicts a phase in which weight-on-bit and associated forces are increased to crush or otherwise disintegrate the stop component 52. FIG. 9 depicts a phase in which part of the inner string 30 is advanced beyond the outer string 32 in preparation for drilling.

At block 71, the outer string 32 is deployed to a selected borehole location or depth. It is noted that "depth" refers to a distance from the surface along the borehole 14 (measured depth (MD)). Alternatively, depth may correspond to true vertical depth (TVD), which is the shortest distance between a specific location in the borehole 14 and the surface, or the vertical distance from a specific location in the borehole to the surface. The measured depth of a borehole or the measured depth of a component in a borehole is usually measured by adding the lengths of the components that make up a downhole string when running the downhole string in hole, such as tripping in a drill string. The measured depth of the borehole or the measured depth of a component in the borehole may be performed by a depth measurement device. The depth measurement device includes a processor that monitors the signal of a drawworks encoder. A drawworks encoder is well known and not further described herein. Apart from measuring the measured depth, the depth measurement device is configured to measure the distance (axial distance) the inner string 30 is moved inside the outer string 32 to adjust the relative positions of the inner and outer string to each other in order to align structures in the outer string 32 with corresponding structures the inner string 30.

For example, as shown in FIG. 6, the outer string 32 is deployed downhole and secured to the surface via slips 80. The outer string may be run in a host casing 33. The outer string 32 includes the liner 34, the liner shoe 36 and the tagging assembly 50. In this example, the stop component 52 is a glass disc capable of withstanding a force in down-hole direction (applied, e.g., by a drill bit or other disintegrating device) below a selected axial threshold force. For example, the axial threshold force corresponds to a weight-on-bit of (WOB) about three tons, or about six tons, or about ten tons of axial force, or any other threshold. The stop component 52 may be glass or any other material (e.g., ceramic or cement) having a sufficient brittleness so that the stop component 52 is crushed and/or shatters into pieces that are small enough to be circulated by borehole fluid without obstructing the borehole or downhole components, or otherwise interfering with the proper operation of the downhole components. The stop component 52 may be disposed in the liner shoe 36 that is specifically suited for liner drilling. The liner shoe 36 may comprise a stabilizer 35 with stabilizer blades. The liner shoe 36 includes an increased wall thickness compared to a standard liner. The liner 34 may have for example an outer diameter of about 7 inches and the liner shoe 36 may have an outer diameter of about 8.5 inches. The inner diameter of the liner 34, the liner shoe 36 and the reamer bit may be about 6 inches. The liner shoe 36, in an embodiment, includes a connection at the downhole end to connect a reamer bit (pin-box connection). In a non-limiting example, the connection may be a cylindrical connection as displayed in FIG. 2. The connection between the liner shoe 36 and the reamer bit may be used to secure the stop component 52 in the outer string 32. The stop component 52 may be disposed in the liner shoe 36 at or proximate the stabilizer 35 position.

At block 72, the inner string 30 is deployed through the outer string. In the example of FIG. 7, the inner string 30 is a drill string that is deployed using a drill rig with a hoisting system and a top drive system 82 or other suitable equipment. The inner string 30 includes, for example, string segments 84, such as pup joints or pipe segments, and a BHA 86. The inner string 30 is not so limited and can be made from any suitable components, such as wireline or coiled tubing.

Referring to FIG. 7, for example, the BHA 86 includes a drill bit and steering system, such as the pilot bit 22 connected to the steering device 40, and the LWD/MWD device 42. Additional drill bits and/or other disintegrating devices may be included, such as a reamer bit 88 on the liner shoe 36, and/or a hole opening device 90 that includes an extendable under-reamer 92. The hole opening device 90 and the pilot bit 22 may be driven by a downhole motor (mud motor) 94 and/or driven from the surface via, for example, the top drive 82. Power can be supplied to the BHA 86 and communications can be transmitted using a communication and power module 96, which can be connected to a battery sub 98 and/or a surface unit (e.g., via a cable or wireline).

At block 73, the inner string 30 is advanced through the outer string 32 until a drill bit or other component of the inner string 30 engages the stop component 52. A component may "engage" the stop component by directly contacting the stop component 52, contacting another component of the tagging assembly 50 that transfers force to the stop component 52, or in any other manner that causes force to be applied to the stop component 52.

Referring again to FIG. 7, for example, the inner string 30 is advanced using an initially selected WOB. When the pilot bit 22 contacts or is otherwise stopped by the stop component 52, it can be immediately detected at the surface.

At block 74, the depth or location of the pilot bit 22 (relative to the outer string 32) is known. Also known is the measured depth of the pilot bit. It is also known the relative positions of the other components of the inner string 30, such as the hole opening device 90 and the motor 94. An operator and/or processing device determines based on the relative positions whether the inner string 30 is properly positioned, and makes any length or position adjustments as needed.

At block 75, the force on the stop component 52 is increased above an axial threshold force in order to crush, shatter or otherwise disintegrate the stopping device 52. For example, referring to FIG. 8, the weight on bit is increased to exceed a threshold weight (e.g., about three tons), which crushes the stop component 52. Circulation of fluid can then be used to remove the pieces of the crushed stop component 52. Alternatively, pieces of the crushed stop component 52 remain in the borehole and may be circulated out of the borehole and/or further crushed during drilling.

At block 76, once the position of the inner string 30 is confirmed and/or adjusted, assembly processes are performed to ready the inner string 30 and the drilling assembly 20 for drilling. The inner string 30 is advanced so that the pilot bit 22 is beyond (below) the outer string 32 and in position to commence drilling. For example, referring to FIG. 9, the inner string 30 is advanced beyond the liner shoe 36 until the motor 94 is engaged with or proximate to the liner shoe 36, and the hole opening device 90 is outside of the liner 34 and the liner shoe 36. The under-reamer 92 can then be radially extended and the drilling assembly of the inner string 30 can be rotated to perform the drilling operation.

At block 77, after the assembly process is completed, the entire drilling and completion assembly 20 can be advanced to the bottom of borehole 14 to commence a drilling operation.

The method 70 may be performed in an automated manner without the interaction of a human operator. A processor in a surface processing unit 46 may control a hoisting system in the drill rig located at the surface used to control the movement of the inner string 30 within the outer string 32. The processor may monitor weight-on-bit data using a weight-on-bit measurement device to detect the inner string engaging the stop component 52. The processor may calibrate the relative positions of the inner and outer string (tagging position) and may increase axial force on the stop component 52 to disintegrate the stop component 52. The processor may adjust the relative positions of the inner and outer string to each other using a depth measurement device. The processor may initiate a downhole operation, such as connecting the inner string to the outer string using a running tool and commencing drilling using the inner and outer string.

Set forth below are some embodiments of the foregoing disclosure:

Embodiment 1

An apparatus for determining a location of an inner string in an outer string of a downhole system, comprising an axis parallel to a longitudinal axis of the inner string; a tagging assembly disposed at a tagging location in the outer string, the outer string configured to be deployed into a borehole in a subterranean region, the inner string configured to be advanced through the outer string, the tagging assembly including: a stop component configured to obstruct axial movement of the inner string through the outer string at the tagging location, the stop component configured to be displaced in response to an axial force applied to the stop component by the inner string, to permit the inner string to advance axially beyond the tagging assembly.

Embodiment 2

The apparatus of any prior embodiment, further comprising a depth measurement device configured to measure an axial distance along the axis moved by the inner string relative to the outer string.

Embodiment 3

The apparatus of any prior embodiment, further comprising a weight-on-bit measurement device configured to measure weight-on-bit to detect tagging of the stop component by the inner string.

Embodiment 4

The apparatus of any prior embodiment, wherein the stop component is made from at least one of cement, plastic and glass.

Embodiment 5

The apparatus of any prior embodiment, wherein the stop component is connected to a support structure of the outer string, the support structure configured to prevent axial movement of the stop component before displacement of the stop component.

Embodiment 6

The apparatus of any prior embodiment, wherein the stop component is configured to disintegrate in response to the axial force being beyond an axial threshold force.

Embodiment 7

The apparatus of any prior embodiment, wherein the stop component is made from a material configured to maintain the inner string at a tagging position up to the axial threshold force applied by the inner string, the material having a brittleness so that the axial threshold force causes the stop component to disintegrate.

Embodiment 8

The apparatus of any prior embodiment, wherein the stop component is made from a material configured to maintain the inner string at a tagging position up to the axial threshold force applied by the inner string, and deform and be displaced in response to the axial threshold force to permit the inner string to advance axially.

Embodiment 9

The apparatus of any prior embodiment, wherein the stop component is configured to permit fluid flow through the outer string.

Embodiment 10

The apparatus of any prior embodiment, wherein the stop component is configured to prevent fluid flow through the outer string.

Embodiment 11

The apparatus of any prior embodiment, wherein the tagging assembly comprises a sealing element.

Embodiment 12

The apparatus of any prior embodiment, further comprising a force distribution component disposed on a surface of the stop component, the force distribution component configured to distribute the axial force applied by the inner string upon engagement with the tagging assembly.

Embodiment 13

The apparatus of any prior embodiment, further comprising at least one of an additional layer and a separate element made from at least one material that is different than a material making up the stop component, the at least one material configured to dampen an impact load when the inner string contacts the tagging assembly.

Embodiment 14

The apparatus of any prior embodiment, wherein the force distribution component includes a plurality of segments and is made from a polymer material.

Embodiment 15

The apparatus of any prior embodiment, wherein the stop component includes an opening.

Embodiment 16

A method of determining a location of an inner string in an outer string of a downhole system, comprising: deploying the outer string into a borehole in a subterranean region, the outer string including a tagging assembly, the tagging assembly including a stop component disposed at a tagging location in the outer string; deploying the inner string and advancing the inner string until the inner string engages the stop component, the stop component obstructing axial movement of the inner string at the tagging location; performing a measurement to determine a position of the inner string relative to the outer string; displacing the stop component by applying an axial force to the stop component by the inner string to permit the inner string to advance axially beyond the tagging assembly; and performing a downhole operation based on the measurement.

Embodiment 17

The method of any prior embodiment, further comprising adjusting the position of the inner string relative to the outer string prior to the downhole operation.

Embodiment 18

The method of any prior embodiment, further comprising measuring weight-on-bit to detect the tagging location.

Embodiment 19

The method of any prior embodiment, wherein displacing the stop component includes disintegrating the stop component by applying an axial force that is beyond an axial threshold force.

Embodiment 20

The method of any prior embodiment, further comprising circulating the disintegrated stop component out of the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. An apparatus for determining a location of an inner string in an outer string of a downhole system, comprising:

an axis parallel to a longitudinal axis of the inner string; and a tagging assembly disposed at a tagging location in the outer string, the outer string configured to be deployed into a borehole in a subterranean region, the inner string configured to be advanced through the outer string along the axis, the tagging assembly including:

a stop component made from a material having a brittleness and being disposed in the outer string and configured to obstruct axial movement of the inner string through the outer string at the tagging location, the stop component including an uphole side and a downhole side, the stop component configured to be displaced in response to an axial force applied to the stop component by the inner string, to permit the inner string to advance axially beyond the tagging assembly;

a force distribution component configured to distribute the axial force applied by the inner string upon contacting the tagging assembly, the force distribution component disposed on the uphole side of the stop component, the force distribution component made from a material having a brittleness that is less than the brittleness of the material of the stop component; and an impact dampening component configured to dampen an impact of the inner string on the stop component, the impact dampening component disposed between the stop component and the force distribution component, and the impact dampening component made from a flexible material that is different than the material of the stop component.

2. The apparatus of claim 1, further comprising a depth measurement device configured to measure an axial distance along the axis moved by the inner string relative to the outer string.

3. The apparatus of claim 1, further comprising a weight-on-bit measurement device configured to measure weight-on-bit to detect tagging of the stop component by the inner string.

4. The apparatus of claim 1, wherein the stop component is made from at least one of cement and glass.

5. The apparatus of claim 1, wherein the stop component is connected to a support structure of the outer string, the support structure configured to prevent axial movement of the stop component before the displacement of the stop component.

6. The apparatus of claim 1, wherein the stop component is configured to disintegrate in response to the axial force being beyond an axial threshold force.

7. The apparatus of claim 6, wherein the stop component is configured to maintain the inner string at a tagging position up to the axial threshold force applied by the inner string.

8. The apparatus of claim 1, wherein the stop component is configured to prevent fluid flow through the outer string.

9. The apparatus of claim 8, wherein the tagging assembly comprises a sealing element.

10. The apparatus of claim 1, wherein the force distribution component is made from a polymer material.

11. The apparatus of claim 1, wherein the stop component includes an opening.

12. The apparatus of claim 1, wherein the tagging assembly includes a lateral damping element disposed between the stop component and the outer string, the lateral dampening element configured to dampen lateral impacts on the stop component.

13. The apparatus of claim 1, wherein the force distribution component includes a weakening feature defining breaking points, the weakening feature causing the force distribution component to break into a plurality of segments.

14. The apparatus of claim 1, wherein the stop component is configured to disintegrate into a plurality of stop component pieces in response to the axial force being beyond an axial threshold force, and the force distribution component is configured to break into a plurality of force distribution component segments in response to the stop component being disintegrated in response to the axial force being beyond the axial threshold force, the plurality of stop component pieces and the plurality of force distribution component segments configured to be circulated out of the borehole via a fluid.

15. The apparatus of claim 1, wherein the material of the impact dampening component is different than the material of the force distribution component.

16. The apparatus of claim 1, wherein the impact dampening component includes a plurality of discrete impact dampening elements configured to dampen an impact of the inner string on the stop component.

17. The apparatus of claim 16, wherein the stop component and the force distribution component each include a disc, and the plurality of discrete impact dampening elements are cylindrical elements disposed on a surface of the stop component, wherein the surface of the stop component is at the uphole side of the stop component.

18. The apparatus of claim 16, wherein the plurality of the impact dampening elements are made from a rubber or a polymer material.

19. The apparatus of claim 1, wherein the stop component includes a plurality of discs.

20. An apparatus for determining a location of an inner string in an outer string of a downhole system, comprising:

an axis parallel to a longitudinal axis of the inner string;

a tagging assembly disposed at a tagging location in the outer string, the outer string configured to be deployed into a borehole in a subterranean region, the inner string configured to be advanced through the outer string along the axis, the tagging assembly including:

a stop component made from a material having a brittleness and being disposed in the outer string and configured to obstruct axial movement of the inner string through the outer string at the tagging location, the stop component including an uphole side and a downhole side, the stop component configured to be displaced in response to an axial force applied to the stop component by the inner string, to permit the inner string to advance axially beyond the tagging assembly;

a force distribution component configured to distribute the axial force applied by the inner string upon contacting the tagging assembly, the force distribution component disposed on the uphole side of the stop component, the force distribution component made from a material having a brittleness that is less than the brittleness of the material of the stop component, the force distribution component configured to break into a plurality of segments in response to the axial force applied to the stop component; and an impact dampening component configured to dampen an impact of the inner string on the stop component, the impact dampening component disposed between the force distribution component and the stop component, the impact dampening component made from a flexible material that is different than the material of the stop component.

21. The apparatus of claim 20, wherein the impact dampening component includes a plurality of discrete impact dampening elements configured to dampen an impact of the inner string on the stop component.

22. The apparatus of claim 20, wherein the tagging assembly further includes a lower impact dampening element, the lower impact dampening element located downhole of the stop component.

23. The apparatus of claim 20, wherein the material of the impact dampening component is different than the material of the force distribution component.

* * * * *